US008193436B2

(12) United States Patent
Sim et al.

(10) Patent No.: US 8,193,436 B2
(45) Date of Patent: Jun. 5, 2012

(54) SEGMENTING A HUMMING SIGNAL INTO MUSICAL NOTES

(75) Inventors: Yong Hwee Sim, Singapore (SG); Chun Woei Teo, Singapore (SG); Sua Hong Neo, Singapore (SG); Kok Seng Chong, Singapore (SG)

(73) Assignee: Matsushita Electric Industrial Co., Ltd., Osaka (JP)

( * ) Notice: Subject to any disclaimer, the term of this patent is extended or adjusted under 35 U.S.C. 154(b) by 816 days.

(21) Appl. No.: 11/921,593

(22) PCT Filed: Jun. 7, 2005

(86) PCT No.: PCT/SG2005/000183

§ 371 (c)(1),
(2), (4) Date: Jan. 12, 2009

(87) PCT Pub. No.: WO2006/132599

PCT Pub. Date: Dec. 14, 2006

(65) Prior Publication Data

US 2009/0171485 A1 Jul. 2, 2009

(51) Int. Cl.
*G10H 7/00* (2006.01)

(52) U.S. Cl. ..... 84/616; 84/609; 84/654

(58) Field of Classification Search ..... 84/616, 84/654, 609

See application file for complete search history.

(56) References Cited

U.S. PATENT DOCUMENTS

| | | | | |
|---|---|---|---|---|
| 5,038,658 | A | 8/1991 | Tsuruta et al. | |
| 5,874,686 | A | 2/1999 | Ghias et al. | |
| 6,124,544 | A | 9/2000 | Alexander et al. | |
| 7,825,321 | B2 * | 11/2010 | Bloom et al. | 84/622 |
| 7,919,706 | B2 * | 4/2011 | Tsui et al. | 84/618 |
| 2007/0163425 | A1 * | 7/2007 | Tsui et al. | 84/609 |
| 2008/0202321 | A1 * | 8/2008 | Goto et al. | 84/616 |

FOREIGN PATENT DOCUMENTS

WO WO 2004/034375 A1 4/2004

OTHER PUBLICATIONS

Shih, H., et al., "Multidimensional Humming Transcription Using a Statistical Approach for Query by Humming Systems," *2003 International Conference on Multimedia and Expo*, ICME'03, Jul. 2003.

Pauws, S., "CubyHum: A Fully Operational Query by Humming System," *3rd International Conference on Music Information Retrieval*, ISMIR 2002, IRCAM Centre Pompidou, Oct. 2002.

(Continued)

*Primary Examiner* — Jeffrey Donels

(74) *Attorney, Agent, or Firm* — Patterson Thuente Christensen Pedersen, P.A.

(57) ABSTRACT

A method (100) and apparatus (200) are disclosed for transcribing a humming signal into a sequence of musical notes. The method begins by grouping (305) the signal into frames of data samples. Each frame is then processed to derive (320) a frequency distribution for each frames. The frequency distributions are processed to derive (410) a Harmonic Product Energy (HPE) distribution over the frames. The HPE distribution is then segmented (115, 120) to obtain boundaries of musical notes. The frequency distributions of the frames are also processed to derive (412) a fundamental frequency distribution. A pitch for each note is determined (125) from the fundamental frequency distribution.

11 Claims, 12 Drawing Sheets

OTHER PUBLICATIONS

Haus, G., et al., "An Audio Front End for Query-by-Humming Systems," *Proceedings of the 2nd International Symposium on Music Information Retrieval*, Bloomington, Indiana, University of Indiana, 2001.

McNab, R., et al., "Signal Processing for Melody Transcription," *Proceedings of the 19th Australasian Computer Science Conference*, Melbourne, Australia, 1996.

Paiva, R.P., et al., "A Methodology for Detection of Melody in Polyphonic Musical Signals," *Audio Engineering Society Convention Paper 6029*, 2004.

Bello, J.P., et al., "Techniques for Automatic Music Transcription," *International Symposium on Music Information Retrieval*, Department of Electronic Engineering, King's College London, 2000.

* cited by examiner

Long Pause

Distinct Pause

◆ Unstable Frame

SEGMENTING A HUMMING SIGNAL INTO MUSICAL NOTES

FIELD OF THE INVENTION

The present invention relates generally to audio or speech processing and, in particular, to segmenting a humming signal into musical notes.

BACKGROUND

Multimedia content has become extremely popular over recent years. The popularity of such multimedia content is mainly due to the convenience of transferring and storing such content. This convenience is made possible by the wide availability of audio formats, such as the MP3 format, which are very compact, and an increase of media bandwidth to the home, such as broadband Internet. Also, the emergence of 3G wireless devices assists in the convenient distribution of multimedia content.

With such a large amount of multimedia content being available to users, an increasing need exists for an effective searching mechanism for multimedia content. One possible way of searching is "retrieval by humming", whereby a user searches for a desired musical piece by humming the melody of that desired musical pieces to a system. The system in response then outputs to the user information about the musical piece associated with the hummed melody.

Humming is defined herein as singing a melody of a song without expressing the actual words or lyrics of that song.

Besides multimedia retrieval purposes, transcribing of melodies that are in acoustic waveforms, such as a humming signal, into written representation, for example musical notes, is very useful as well. Songwriters can compose tunes without a need for instruments, or students can practice by humming on their own.

As a result, effective processing of humming signals into musical notes is desirable. The musical notes should contain information such as the pitch, the start time and the duration of the respective notes.

In order to effectively process such a humming signal, two distinct steps are required. The first step is the segmentation of the acoustic wave representing the humming signal into notes, whereby determining the start time and duration of each note, and the second step is the detection of the pitch of each segment (or note). The segmentation of the acoustic wave is not as straightforward as it may appear, as there is difficulty in defining the boundary of each note in an acoustic wave. Also, there is considerable controversy over exactly what pitch is.

In the case where the note is made up from a single frequency the frequency of the note is also the pitch. However, a musical note, especially when produced by a human vocal system, is made up from more than one frequency. Accordingly, pitch generally refers to the fundamental frequency of a note.

In most prior art, it is assumed that each note will have a peak in amplitude/power or will be separated by a reasonable amount of silence, and these aspects are used for the segmentation of the acoustic signal. In reality the segmentation of the acoustic signal is considerably more complex.

For example, as is described in U.S. Pat. No. 5,874,686 issued on Feb. 23, 1999, after the peak energy levels of the signal are isolated and tracked, autocorrelation is performed on the signal around those peaks to detect the pitch of each note. In order to improve the performance, speech and robustness of the pitch-tracking algorithm, a cubic-spline wavelet transform (or other suitable wavelet transform) is used.

U.S. Pat. No. 5,038,658 issued on Aug. 13, 1991 discloses segmentation based on both power and pitch information. The final note boundaries are determined without being influenced by fluctuations in acoustic signals or abrupt intrusions of outside sounds.

In the method disclosed in International publication No. WO2004034375, the humming signal is subjected to a process of segmentation based on amplitude gradient that comprises the steps of subjecting the signal to a process of envelope detection, followed by a process of differentiation to calculate a gradient function. This gradient function is then used to determine the note boundaries.

Segmentation may also be done by differentiating the characteristics between onset/offset (unvoiced) and steady state (voiced) portion of the note. A known technique for performing voiced/unvoiced discrimination from the field of speech recognition is relying on the estimation of the Root Mean Square (RMS) power and the Zero Crossing Rate.

Yet another method used for segmenting an acoustic signal is by first grouping a data sample stream of the acoustic signal into frames, with each frame including a predetermined number of data samples. It is usual for the frames to have some degree of overlap of samples. A spectral transformation, such as the Fast Fourier Transform (FFT), is performed on each frame, and a fundamental frequency obtained. This creates a frequency distribution over the frames. Segmentation is then performed by tracking clusters of similar frequencies. Energy or power information is often also used for analysing the signal to identify repeated or glissando notes within each group of frames having a similar frequency distribution.

The prior art methods described above lead to inaccuracies in the segmentation of humming signals, and inaccuracy in the segmentation directly leads to poor results in overall transcription of the humming signal into musical notes.

Tracking of frequency changes alone could not accurately segment notes because in practice, there will exist fast repeating or glissando notes within the humming signal. As a result, pauses in-between these notes cannot be identified easily. Furthermore, a person creating the humming signal is generally unable to maintain a pitch. This results in pitch changes within a single note. This may in turn be subsequently misinterpreted as note change.

Using of energy or power distribution, whether the distribution is as a result of average energy over frames or amplitude/power over samples, to segment the humming signal into notes has difficulties associated as well. For example, the difference in energy level between the high-energy and low-energy notes is often large. Accordingly, using a global threshold to threshold the energy distribution is not possible. An adaptive threshold is required, which in turn requires significant processing time because the value of the adaptive threshold is difficult to calculate. This is particularly true for acoustic signals derived from a male as there is generally no specific pattern in the change in the energy or power information. Hummed songs have fluctuations in relation to the pattern of change. In addition, the sound to be transcribed also often contains abrupt sounds, such as outside noises. In these circumstances, a simple segmentation of sound based on change in the power information would not necessarily lead to any good segmentation of individual sounds.

Furthermore, if the person humming does not pause adequately when humming a string of the same notes, the transcription system might interpret the string of the same notes as a single note. The task also becomes increasingly difficult in the presence of expressive variations and the physical limitation of the human vocal system.

SUMMARY

It is an object of the present invention to substantially overcome, or at least ameliorate, one or more disadvantages of existing arrangements.

According to a first aspect of the present invention there is provided a method for segmenting a data sample stream of a humming signal into musical notes, said method comprising the steps of:

grouping said data sample stream into frames of data samples;

processing each frame of data samples to derive a frequency distribution for each of said frames;

processing said frequency distributions of said frames to derive a Harmonic Product Energy (HPE) distribution;

segmenting said HPE distribution to obtain boundaries of musical notes.

According to another aspect of the present invention, there is provided an apparatus for implementing any one of the aforementioned method.

According to yet another aspect of the present invention there is provided a computer program product including a computer readable medium having recorded thereon a computer program for implementing the method described above.

Other aspects of the invention are also disclosed.

BRIEF DESCRIPTION OF THE DRAWINGS

One or more embodiments of the present invention will now be described with reference to the drawings, in which.

DETAILED DESCRIPTION

Figure 1A:
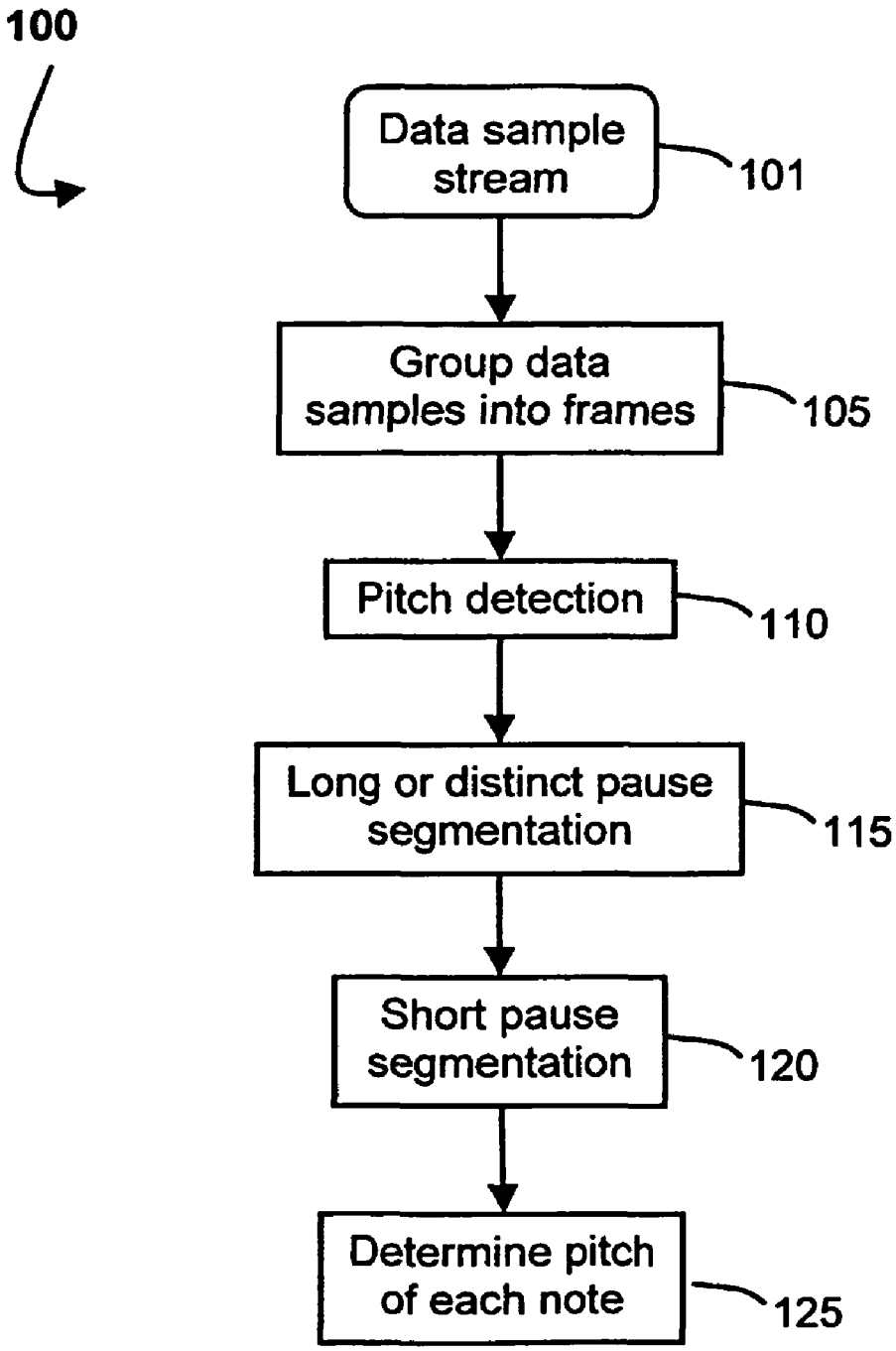
FIG. 1A shows a schematic flow diagram of a method of transcribing a data sample stream of a humming signal into musical notes.

Where reference is made in any one or more of the accompanying drawings to steps and/or features, which have the same reference numerals, those steps and/or features have for the purposes of this description the same function(s) or operation(s), unless the contrary intention appears.

Overview

For reasons explained in the "Background" section, using of energy or power distribution to segment a humming signal into musical notes leads to inaccuracies in the segmentation. Therefore, a parameter other than energy or power is required which provides a distribution over time that takes a specific pattern in relation to the onset and offset of a note, regardless of different melodies or persons humming. One such possible parameter is timbre of the humming signal. Timbre is mainly determined by the harmonic content of the humming signal, and the dynamic characteristics of the signal, such as vibrato and the attack-decay envelope of the sound.

The inventors have observed that as a humming signal transits from an intended note to another, its timbre changes at the boundary. This is true even for fast repeating or glissando notes. Since the perception of timbre results from the human ear detecting harmonics, the inventors have realised that extracting information about harmonics for use during segmentation would be useful. The manner in which this is done is described in detail below.

Figure 2:
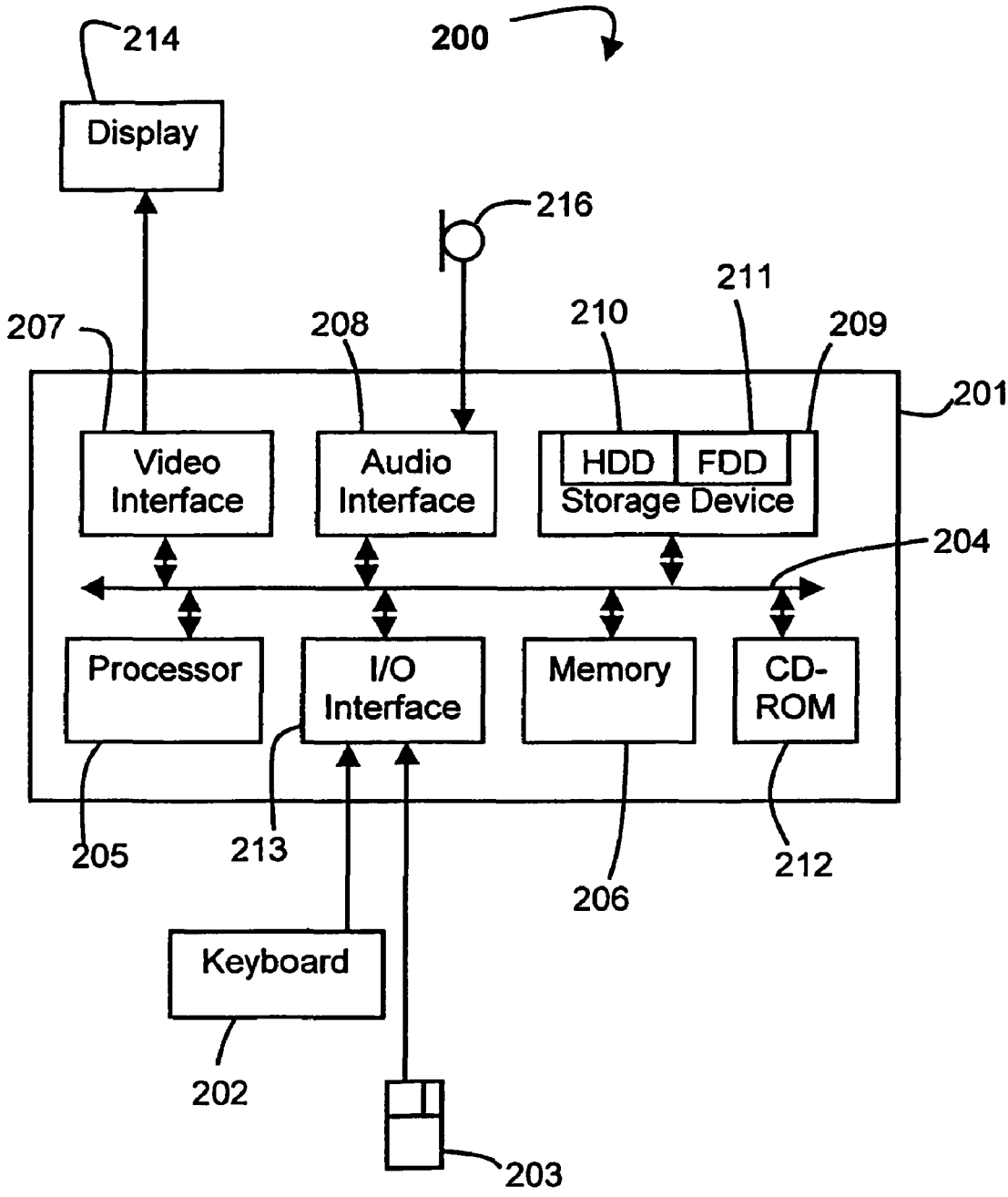
FIG. 2 shows a schematic block diagram of a general purpose computer upon which arrangements described can be practiced.

FIG. 1A shows a schematic flow diagram of a method 100 of transcribing a data sample stream 101 of a humming signal into musical notes. The method 100 shown in FIG. 1A is preferably practiced using a general-purpose computer system 200, such as that shown in FIG. 2 wherein the processes of the method 100 may be implemented as software, such as an application program executing within the computer system 200. In particular, the steps of method 100 of transcribing the data sample stream 101 of a humming signal into musical notes are performed by instructions in the software that are carried out by the computer. The instructions may be formed as one or more code modules, each for performing one or more particular tasks.

The software may be stored in a computer readable medium, including the storage devices described below, for example. The software is loaded into the computer from the computer readable medium, and then executed by the computer. A computer readable medium having such software or computer program recorded on it is a computer program product. The use of the computer program product in the computer preferably effects an advantageous apparatus for transcribing the data sample stream 101 of a humming signal into musical notes.

Computer Implementation

The computer system 200 is formed by a computer module 201, input devices such as a keyboard 202, a mouse 203 and a microphone 216, and output devices including a display device 214. The computer module 201 typically includes at least one processor unit 205, and a memory unit 206, for example formed from semiconductor random access memory (RAM) and read only memory (ROM). The module 201 also includes an number of input/output (I/O) interfaces including a video interface 207 that couples to the video display 214, an I/O interface 213 for the keyboard 202 and mouse 203, and an audio interface 208 for the microphone 216.

A storage device 209 is provided and typically includes a hard disk drive 210 and a floppy disk drive 211. A CD-ROM drive 212 is typically provided as a non-volatile source of data. The components 205 to 213 of the computer module 201, typically communicate via an interconnected bus 204 and in a manner which results in a conventional mode of operation of the computer system 200 known to those in the relevant art.

Typically, the application program is resident on the hard disk drive 210 and read and controlled in its execution by the processor 205. In some instances, the application program may be supplied to the user encoded on a CD-ROM or floppy disk and read via the corresponding drive 212 or 211, or alternatively may be read by the user from a network (not illustrated) via a modern device (not illustrated). Still further, the software can also be loaded into the computer system 200 from other computer readable media. The term "computer readable medium" as used herein refers to any storage or transmission medium that participates in providing instructions and/or data to the computer system 200 for execution and/or processing.

The method 100 of transcribing the data sample stream 101 of a humming signal into musical notes may alternatively be implemented in dedicated hardware such as one or more integrated circuits performing the functions or sub functions thereof.

Methodology

The data sample stream 101 of the humming signal may be formed by the audio interface 208 on receipt of a humming sound through the microphone 216. Alternatively the humming signal may previously have been converted and stored as the data sample stream 101, which is then directly retrievable from the storage device 209 or the CD-ROM 212.

Referring again to FIG. 1A, the method 100 of transcribing the data sample stream 101 of the humming signal into musical notes starts in step 105 where the data sample stream 101 of the humming signal is received as input, and that digital stream is grouped into overlapping flames of the data samples. The grouping of the digital stream 101 preferably comprises a number of sub-steps which are shown in more detail in FIG. 1B.

Figure 1B:
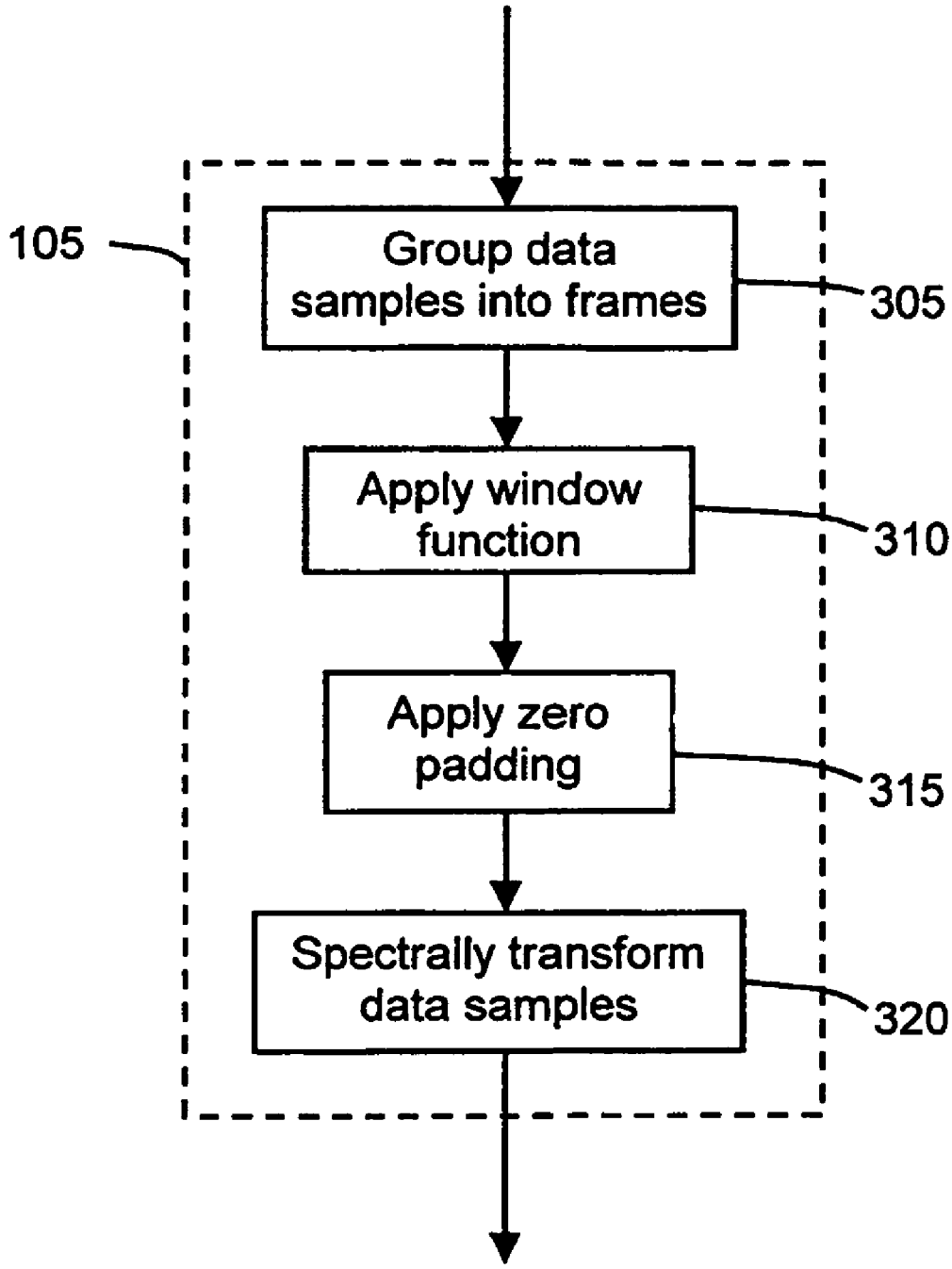
FIGS. 1B to 1F show schematic flow diagrams of steps within the method shown in FIG. 1A in more detail.

Referring to FIG. 1B where a schematic flow diagram of step 105 is shown, step 105 starts in sub-step 305 where the data sample stream 101 is grouped into frames, each consisting of a fixed number of data samples. Also, in order to allow for a smooth transition between frames, a 50% frame overlap is employed. In sub-step 310 the samples contained in each frame are multiplied by a window function, such as a Hamming window. In sub-step 315 the samples contained in each frame are increased in number through zero-padding. The increased number of samples contained in each frame will assist later in locating minima and maxima in the frequency spectrum more accurately.

In sub-step 320 that follows, the data samples of each frame are spectrally transformed, for example using the Fast Fourier Transform (FFT), to obtain a frequency spectral representation of the data samples of each frame. The spectral representation is expressed using the decibel (dB) scale which, because of its logarithmic nature, shows spectral peaks within the spectral representation more clearly. Step 105 terminates after sub-step 320.

Referring again to FIG. 1A, step 110 receives the spectral representations of the data samples of the frames from step 105, and performs pitch detection thereon in order to locate a fundamental frequency for each frame. The sub-steps of the pitch detection performed in step 110 are set out in FIG. 1C.

Figure 1C:
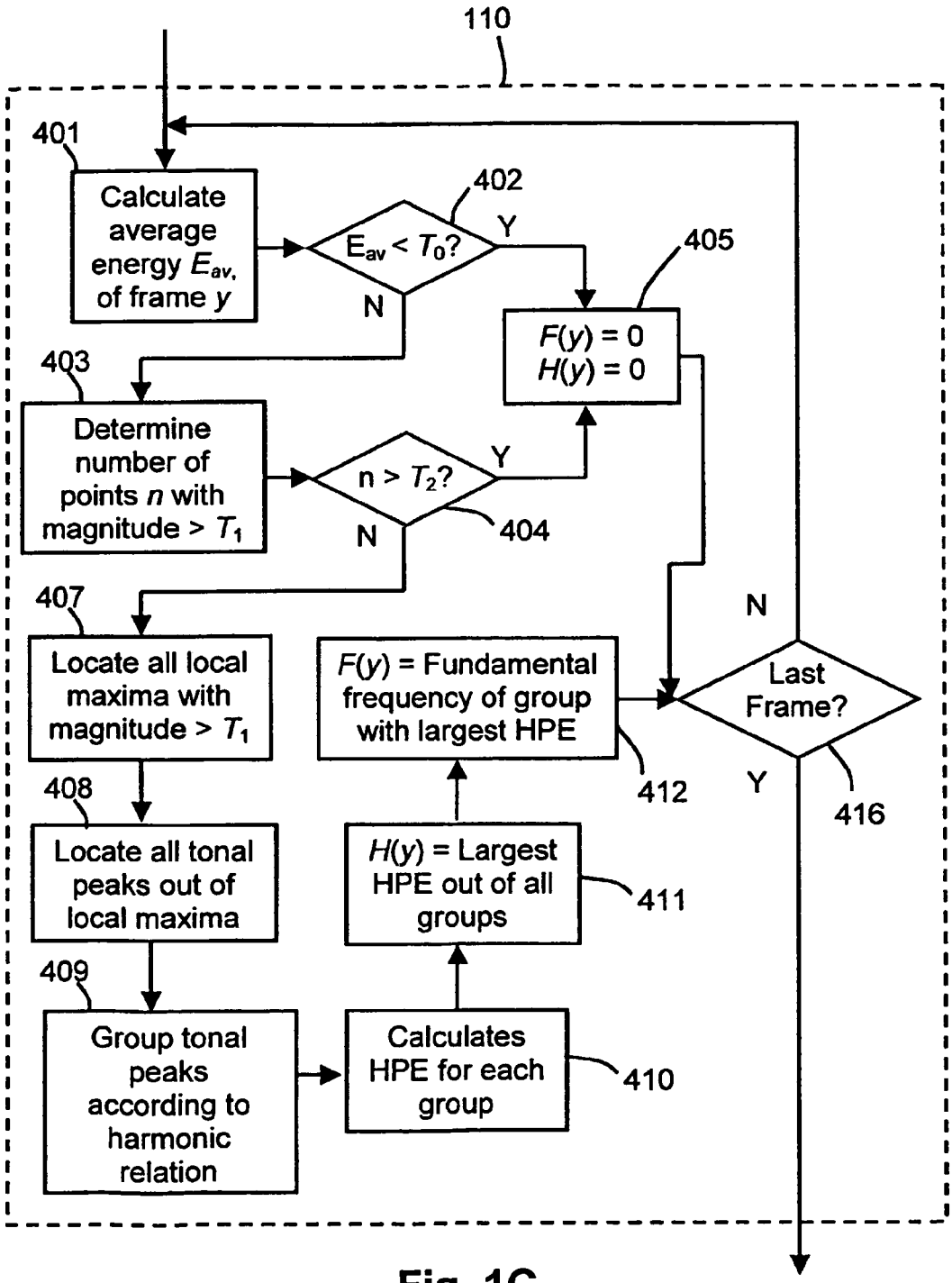

Step 110 starts by analysing each frame y in order to determine whether that frame y contains noise, and hence may be termed a noise frame. A noise frame is defined here as a frame y that contains no tonal components. Accordingly, as shown in FIG. 1C step 110 starts in sub-step 401 where the average frame energy $E_{av}$ of a frame y is calculated. The average frame energy $E_{av}$ of the frame y under consideration is calculated by averaging the energy magnitude of all the frequency components in the spectral representation.

In sub-step 402 the processor 205 then determines whether the average frame energy $E_{av}$ of that frame y is less than a predetermined threshold $T_0$. If it is determined that the average frame energy $E_{av}$ is not less than the threshold $T_0$, then step 110 proceeds to sub-step 403 where the number n of frequency samples in frame y having a magnitude that exceeds a threshold $T_1$ is determined. The threshold $T_1$ is set as a predetermined ratio of the maximum magnitude within the spectral representation of the frame y, with the predetermined ratio preferably being set as 32.5 dB. In sub-step 404 the processor 205 then determines whether the number n is greater that a predetermined threshold $T_2$.

If it is determined in sub-step 404 that the number n is not greater that the threshold $T_2$, then the frame y is considered not to be a noise frame and step 110 proceeds to find the tonal components in that frame y.

Accordingly, step 110 continues to sub-step 407 where all the local maxima with magnitude greater than the threshold $T_1$ within the spectral representation are located. A frequency component b constitutes a local maximum if it has magnitude X(b) that is greater than that of its immediately left neighbour frequency component b−1 and that is not lesser than that of its immediately right neighbour frequency component b+1, hence:

$$X(b)>X(b-1) \text{ AND } X(b)>=X(b+1) \tag{1}$$

Next, in sub-step 408, the local maxima are further processed in order to locate all the tonal peaks from the local maxima. A local maximum has to meet a set of criteria before being designated as a tonal peak. Firstly, the energy X(k) of a local maximum k has to be greater than, or equal to, $S_1$ dB of the energy of both the $2^{nd}$ left neighbour frequency component and the $2^{nd}$ right neighbour frequency component. Secondly, the energy X(k) has to be greater than, or equal to, $S_2$ dB of the energy of both the $3^{rd}$ left neighbour frequency component and $3^{rd}$ right neighbour frequency component, and so on right until the $6^{th}$ left and $6^{th}$ right neighbour frequency components are considered. Hence:

$$X(k)-X(k-2)>=S_1 \text{ AND } X(k)-X(k+2)>=S_1$$

$$X(k)-X(k-3)>=S_2 \text{ AND } X(k)-X(k+3)>=S_2$$

$$X(k)-X(k-4)>=S_3 \text{ AND } X(k)-X(k+4)>=S_3$$

$$X(k)-X(k-5)>=S_5 \text{ AND } X(k)-X(k+5)>=S_4$$

$$X(k)-X(k-6)>=S_5 \text{ AND } X(k)-X(k+6)>=S_5 \tag{2}$$

After all the tonal peaks are located in sub-step 408, harmonically related tonal peaks are grouped together in sub-step 409. Sub-step 410 then calculates a Harmonic Product Energy (HPE) h(f) of each group by adding the energies X(b) (in dB) of all the harmonics in each group as follows:

$$\begin{aligned} h(f_1) &= X(f_1) + X(af_1) + X(bf_1) + \dots , \\ &\vdots \\ h(f_m) &= X(f_m) + X(af_m) + X(bf_m) + \dots , \end{aligned} \tag{3}$$

where $f_m$ is the fundamental frequency corresponding to the harmonic group m, X(f) is the energy, in dB, associated with a frequency f in the spectrum, m is the number of harmonic groups in the frame, a is the multiple the frequency of the second tonal peak (if it exists) of the harmonic group is of the fundamental frequency of the harmonic group, b is the multiple the frequency of the third tonal peak (if it exists) of the harmonic group is of the fundamental frequency of the harmonic group, etc. It is noted that 'addition' in the logarithmic scale is equivalent to 'multiplication' in the non-logarithmic scale.

The group with the largest HPE h(f) is chosen as the dominant harmonic group for the frame y under consideration.

Accordingly, in sub-step 411, the HPE H(v) attributed to frame y is then the HPE of the dominant harmonic group as follows:

$$H(y)=\max\{h(f_1),h(f_2),\ldots,h(d_m)\} \quad (4)$$

A fundamental frequency F(y) of that frame y is set in sub-step 412 to the fundamental frequency of the dominant harmonic group.

Referring again to sub-steps 402 and 404, if it is determined in sub-step 402 that the average frame energy $E_{av}$ is less than the threshold $T_0$, or in sub-step 404 that the number n is greater that the threshold $T_2$ in which case the signal in that frame y is considered to have no tonal components and is regarded as a noise frame, then step 110 continues to sub-step 405 where the fundamental frequency F(y) of that frame y is set to 0. Also, the HPE H(y) of that frame y is set to 0.

From sub-step 405 or sub-step 412 the control within step 110 then passes to sub-step 416 where it is determined whether the frame y just processed was the last frame in the data stream. In the case where more frames remain for processing, then control within step 110 returns to sub-step 401 from where the next frame is processed. Alternatively step 110 terminates.

The output from step 110 is thus the HPE H(y) for each frame y and the fundamental frequency F(y) of that frame y. An HPE distribution and a fundamental frequency distribution over the frames are thus produced.

In other words, for each frame in the data sample stream all the harmonics corresponding to a fundamental frequency, if such harmonics exist, are multiplied together to form a HPE distribution over the frames. The HPE distribution not only contains information about timbre of the humming signal, but also contains information about the average magnitude of the fundamental frequency of the dominant harmonic group at each frame instant. Furthermore, the HPE distribution excludes the energy of components that are not relevant to the fundamental frequency at each frame instant, such as is the case with noise. As a result, the HPE distribution shows the boundaries of notes much more clearly than just an average energy or amplitude distribution.

Figure 3A:
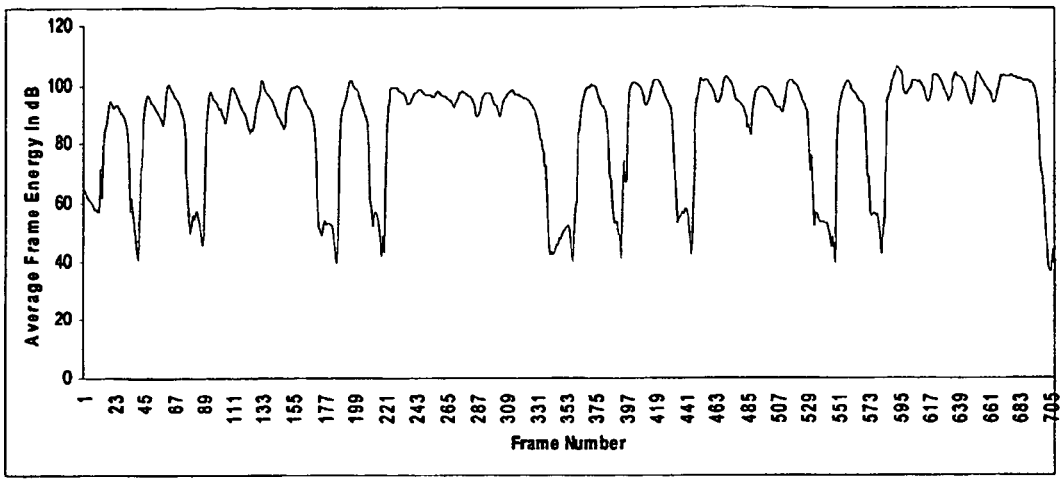
FIGS. 3A and 3B show a comparison between the distributions achieved using frame energy and HPE values of frames respectively.
Figure 3B:
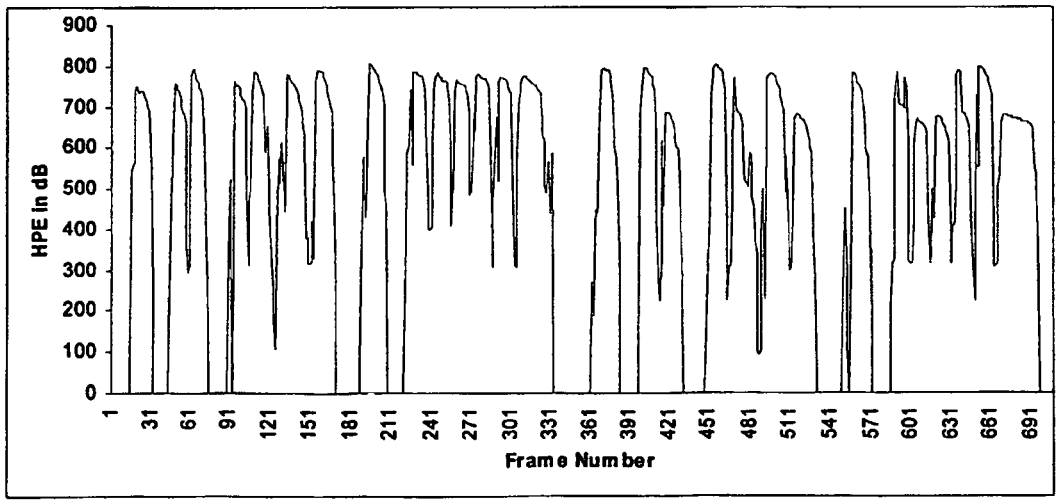

FIGS. 3A and 3B show a comparison between the distributions achieved using frame energy and HPE values of frames respectively, and for an example humming signal. Because the HPE distribution amplifies whatever difference there is in timbre between note regions and note boundary regions, notes can more clearly be distinguished from the graph in shown in FIG. 3B than that shown in FIG. 3A. It is therefore asserted that the HPE distribution is a superior indicator of note boundaries when compared with energy distribution. Overall, the HPE distribution provides a reliable pattern in relation to the onset and offset of each note in the humming signal. This fact is used in what follows to achieve a high level of segmentation accuracy.

Referring again to the method 100 shown in FIG. 1A, following step 110, the method 100 then continues to step 115 where the musical notes that are separated by long or distinct pauses are segmented. Step 115 is followed by step 120 where the notes that are separated by short pauses are segmented. In both step 115 and step 120 the HPE distribution over the frames is used for the segmentation.

Long pauses in the humming signal will typically be represented as noise frames. In step 110 noise frames have been allocated an HPE H(y) value of 0. On the other hand, a distinct pause is typically shown in the HPE distribution as a large dip when compared with the HPE H(y) of the 2 notes separated the dip. Accordingly, the notes that are separated by either a long pause, or a distinct pause, are segmented in step 115 by performing a simple global threshold filtering on the HPE distribution.

Figure 4:
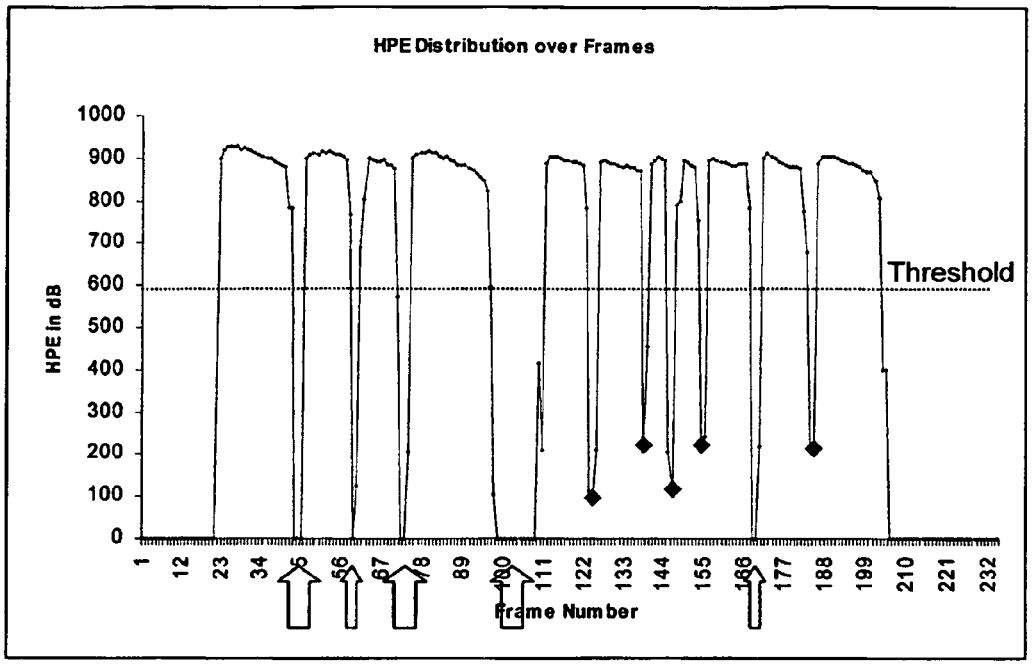
FIG. 4 shows a graph of the Harmonic Product Energy (HPE) distribution of an example humming signal.

FIG. 4 shows a graph of the HPE distribution of an example humming signal. Long pauses are characterised by an HPE H(y) value of 0, while distinct pauses are characterised by low relative HPE H(y) values. The graph in FIG. 4 also shows how the simple global threshold on the HPE distribution is used to segment the notes that are separated by long or distinct pauses.

Figure 1D:
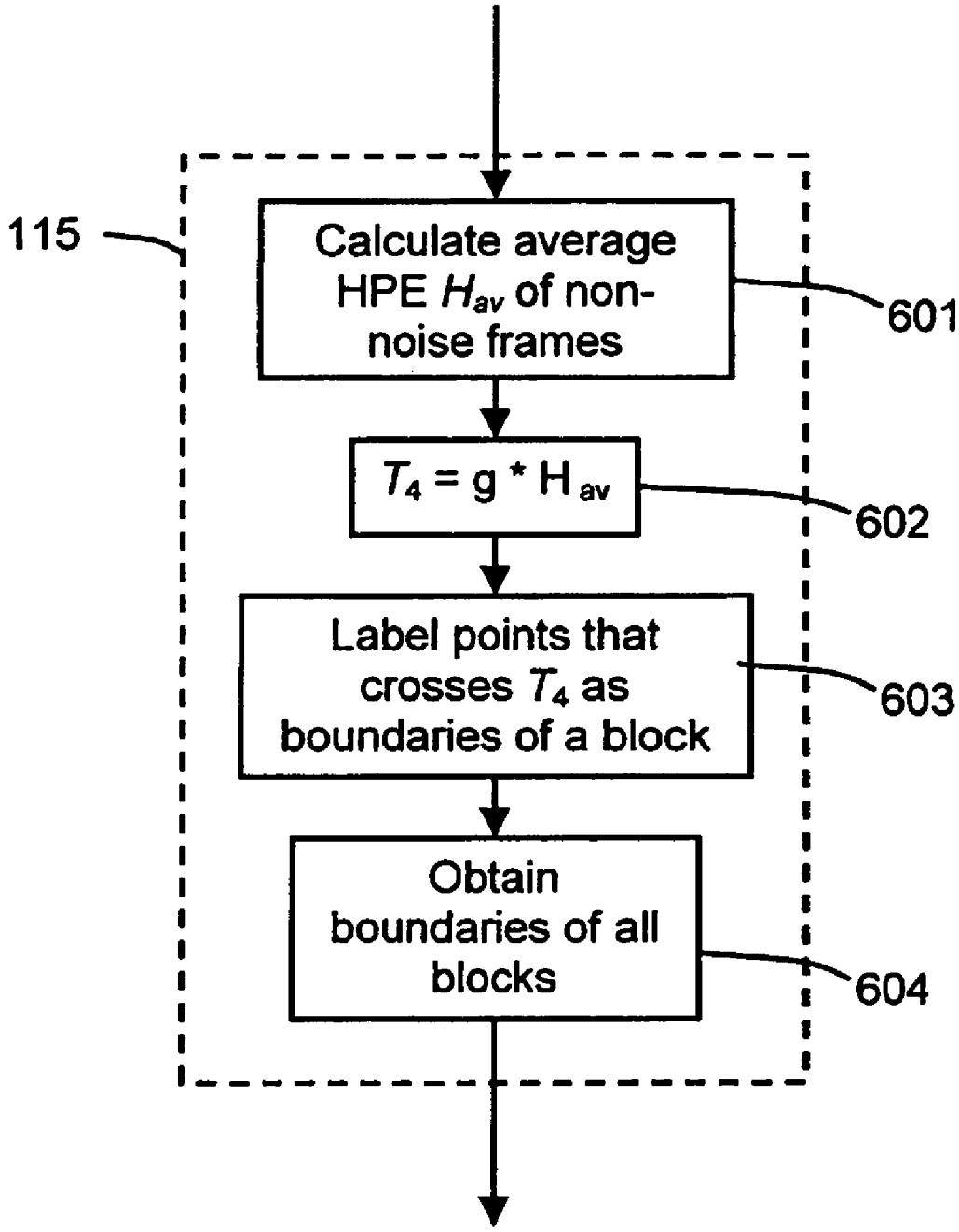

FIG. 1D shows a schematic flow diagram including the sub-steps of step 115. Each section of frames that is separated by long or distinct pauses is defined as a block. Step 115 starts in sub-steps 601 and 602 where the value of a threshold $T_4$ is determined. In particular, the threshold $T_4$ is set in sub-step 602 to be a ratio g of the average $H_{av}$ of all the non-zero HPE H(y) values within the HPE distribution, with the average $H_{av}$ calculated in sub-step 601. The value of the ratio g has to be carefully chosen so that the threshold $T_4$ is higher than the HPE H(y) of distinct pauses, yet low enough to tolerate some fluctuations in HPE H(y) within a note. A value of 0.65 for the ratio g is preferred.

In sub-step 603 the frames Y at which the HPE distribution crosses the threshold $T_4$ from below are labelled as being an 'onset' of blocks. Similarly, the frames y at which the HPE distribution crosses the threshold $T_4$ from above are labelled as being an 'offset' of blocks.

Sub-step 604 then uses the onset and offset frames to obtain the boundary frames of all blocks in the HPE distribution before step 115 terminates.

In practice, few persons humming will deliberately pause for a long time in-between every note. This is especially true when a fast tempo melody is intended. Fast repeating and glissando notes are very common, with the pause in-between fast repeating and glissando notes typically being very short in time and often not detectable in an average energy distribution. However, in the HPE distribution, such short pauses are reflected as clear minima. Typically, these clear minima have a very steep gradient compared to the peaks on either side of those minima. Accordingly, step 120 operates by scanning through the HPE distribution of each block in order to locate short pauses, which are characterised by minima having steep gradients.

Figure 1E:
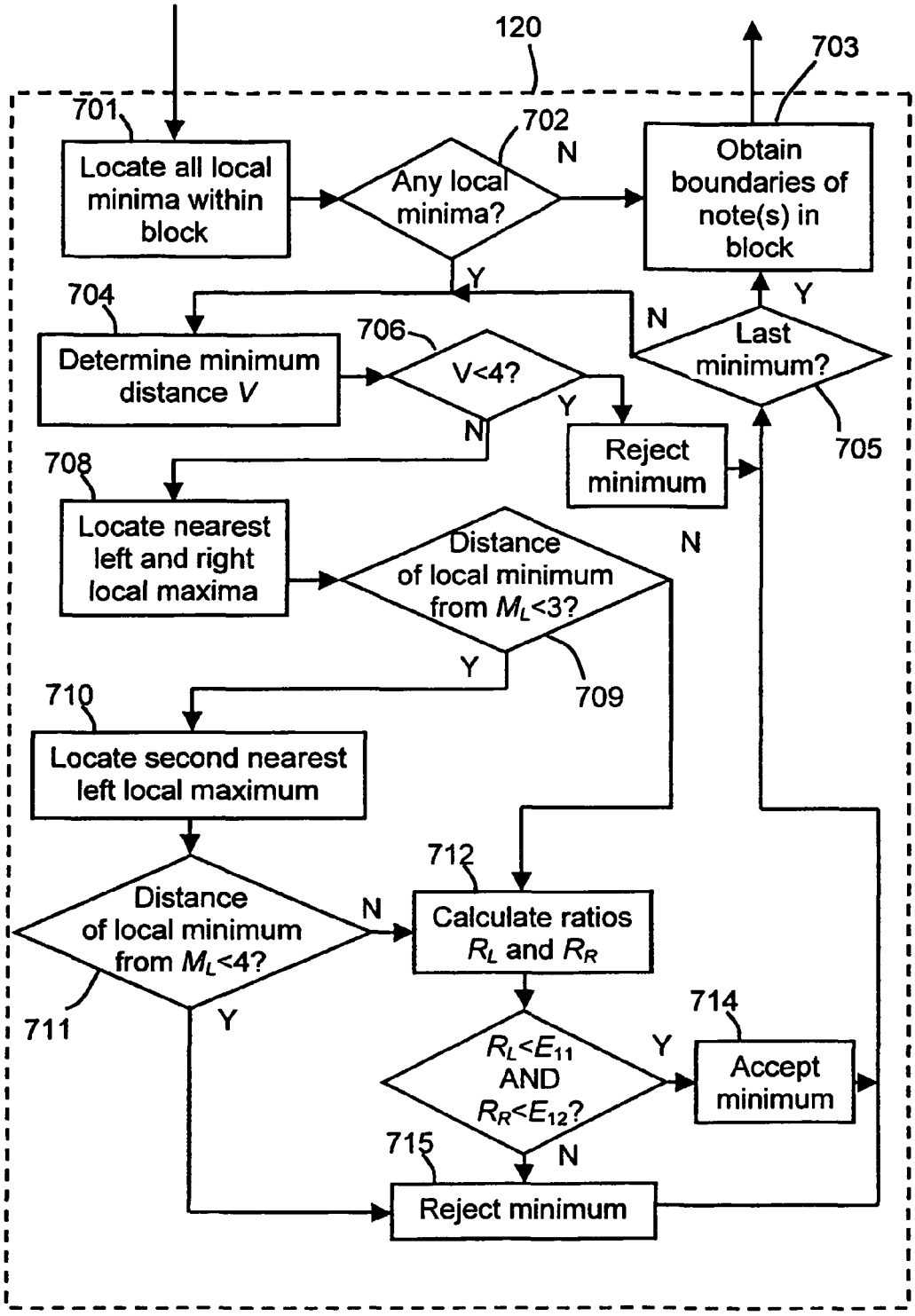

FIG. 1E shows a schematic flow diagram including the sub-steps of step 120. The sub-steps of step 120 are repeated for each block. Step 120 starts in sub-step 701 where all the local minima in the block under consideration are located. These local minima are candidates for representing short pauses. A frame is designated as being a local minimum if the value of its HPE H(y) is less than that of its preceding frame (y−1) and less than or equal to that of its succeeding frame (y+1).

Sub-step 702 then determines whether any local minima exist in the block. In the case where local minima exist in the block, step 120 continues by processing each local minimum in turn. Step 120 continues in sub-step 704 where the minimum distance V of the local minimum from either the left boundary $B_L$ or the right boundary $B_R$ of the block is determined. The left boundary $B_L$ is defined as either the starting frame of the block, or the end frame of a previous segmented note within the block. The right boundary $B_R$ is defined as the end frame of the block.

In sub-step 706 it is then determined whether the minimum distance V is less than 4 frames. If it is determined that the minimum distance V is less than 4 frames then the local minimum is rejected as being associated with a short pause in sub-step 707. In other words, sub-step 706 sets the minimum number of frames of any note to be 3 frames. If the minimum distance V is 3 frames or less, then the number of frames bounded between the local minimum and the boundary would then be 2 or less.

If it is determined in sub-step 706 that the minimum distance V is greater than or equal to 4 frames then, in sub-step 708, a nearest left local maximum $M_L$ and a nearest right local maximum $M_R$ to the local minimum under consideration are located. A frame is designated as being a local maximum if the value of its HPE H(Y) is greater than that of its preceding frame (y−1), and greater than or equal to that of its succeeding frame (y+1). In searching for the local maxima on either side of the local minimum, the search excludes the frames directly next to the local minimum as it is not desired for the local maxima to be too close to a local minimum corresponding to a short pause.

Figure 5:
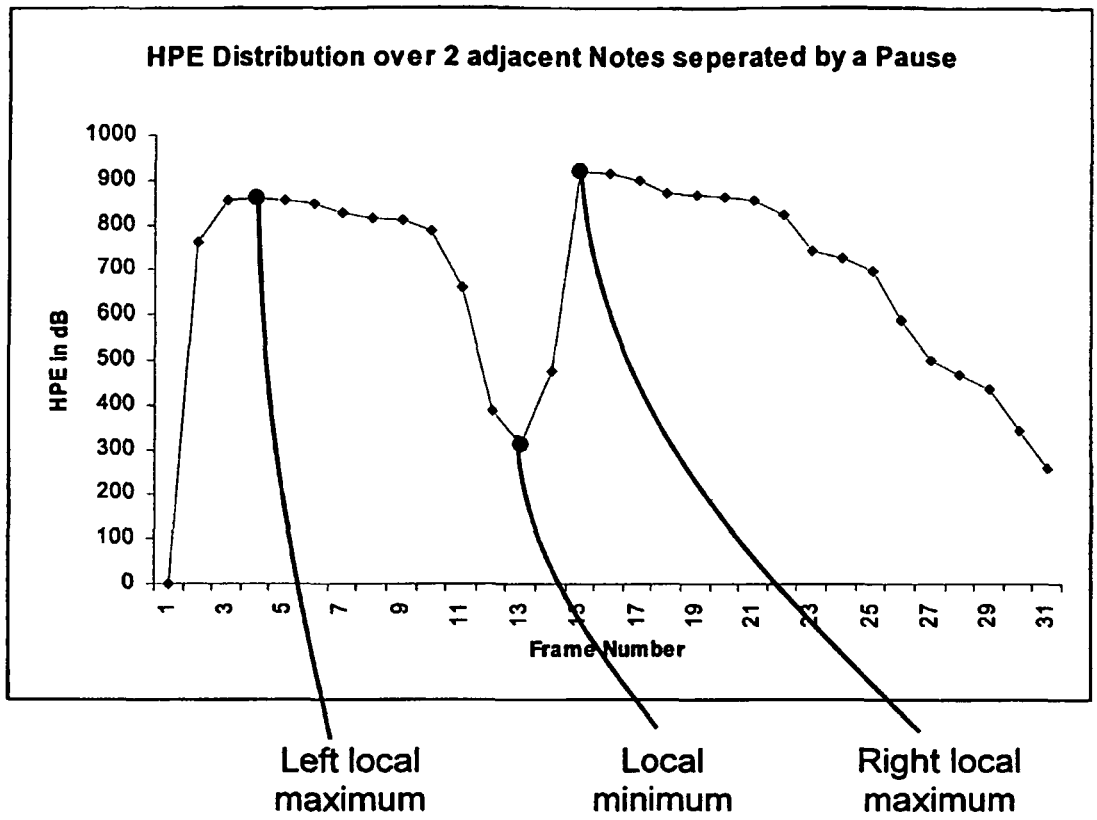
FIG. 5 shows a graph of an example HPE distribution over 2 adjacent notes separated by a short pause.

FIG. 5 shows a graph of an example HPE distribution over 2 adjacent notes separated by a short pause. As can be observed for the example, it often occurs that the local minimum associated with the short pause has a nearest right local maximum. $M_R$ which is near the local minimum, whereas the nearest left local maximum $M_L$ is more remote from the local minimum. This may be explained by the fact that the person humming often hum notes using syllables, such as "da" or "ta". Such syllables starts with plosive sounds causing the start of the note to produce higher HPE H(y) values when compared to the end of the same note. Accordingly, in sub-step 709 it is determined whether the distance of the nearest left local maximum from the local minimum is less than 3 frames.

If it is determined that the distance of the nearest left local maximum $M_L$ from the local minimum is less than 3 frames then, in sub-step 710, a second nearest left local maximum to the local minimum is located, and used as the left local maximum $M_L$ instead. It is then determined in sub-step 711 whether the distance of the second left local maximum $M_L$ from the local minimum is less than 4 frames.

If it is determined that the distance of the second left local maximum $M_L$ from the local minimum is less than 4 frames, then the local minimum is rejected as being associated with a short pause in sub-step 715. This is because a local minimum that has too many local maximums within a short distance away from it is very often caused by unstable humming or by noise, rather than being a pause itself.

Alternatively, if it is determined in sub-step 709 that the distance of the nearest left local maximum from the local minimum is at least 3 frames, or in sub-step 711 that the distance of the second left local maximum from the local minimum is at least 4 frames, then step 120 continues in sub-step 712 where a HPE ratio $R_L$ between the left local maximum $M_L$ and the local minimum, as well as a HPE ratio $R_R$ between the right local maximum $M_R$ and the local minimum, are calculated. Since the HPE values are all in the dB scale, the ratios $R_L$ and $R_R$ are calculated through logarithmic subtraction.

It is then determined in sub-step 713 whether the ratios $R_L$ and $R_R$ are both smaller than thresholds $E_{11}$ and $E_{12}$ respectively. It is observed that the ratio $R_R$ is usually larger in value than the ratio $R_L$. Again, this may be explained by the fact that the person humming often hums notes using syllables, such as "da" or "ta". As a result, the threshold $E_{12}$ used to test the ration $R_R$ is set to a value slightly larger than the threshold $E_{11}$ used for the ratio $R_L$.

If it is determined that both the ratios $R_L$ and $R_R$ are smaller than thresholds $E_{11}$ and $E_{12}$ respectively then, in sub-step 714 the local minimum is accepted as being associated with a short pause. Alternatively, the local minimum is rejected as being associated with a short pause in sub-step 715.

From either of sub-steps 707, 714 or 715 the processing in step 120 then continues to sub-step 705 where it is determined whether the local minimum just processed is the last local minimum within the block under consideration. In the case where more local minima remain for processing, then step 120 returns to sub-step 704 from where the next local minimum is processed to determine whether that local minimum is associated with a short pause.

If it is determined in sub-step 705 that all the local minima within the current block have been processed, or in sub-step 702 that the current block has no local minima, then processing continues in sub-step 703 where the boundaries of all notes in the block are obtained. In the cases where there were no local minima within the block, or where all the local minima were rejected as being associated with a short pause, the whole block represents a single note. In such cases sub-step 703 designates the boundaries of the block as that of the single note.

In the case where at least one local minimum that is associated with a short pause has been found, the first local minimum of the block constitutes the end of the first note in the block. The frame that comes after this local minimum is then the start of the second note in the block. The boundaries of all the notes in the block are obtained in a similar manner.

Step 120 then ends for the current block. If more blocks remain then step 120 is repeated in its entirety for all the remaining blocks. Hence, following step 120 the boundaries of all the notes in the humming signal are obtained.

Figure 6A:
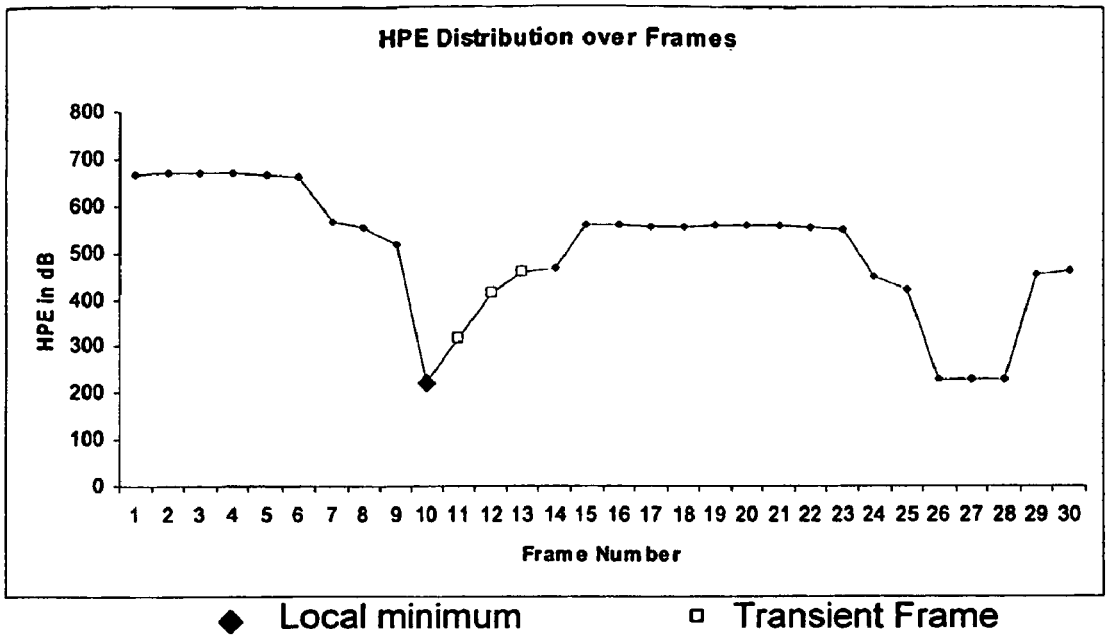
FIG. 6A shows another graph of an example HPE distribution, which includes a frame associated with a short pause.
Figure 6B:
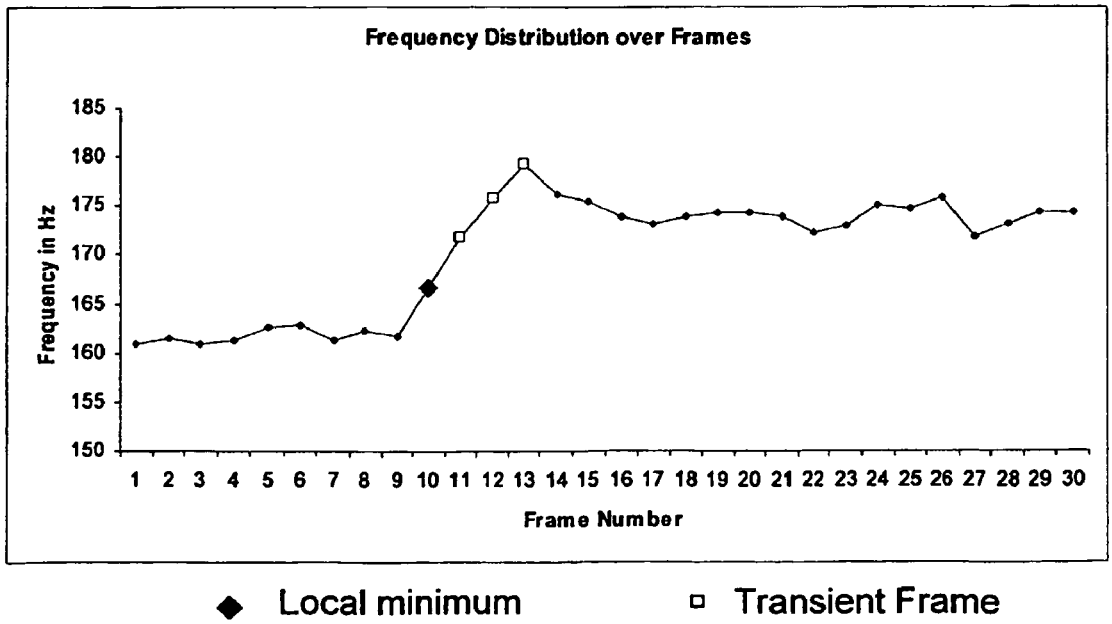
FIG. 6B shows a graph of the fundamental frequency distribution of the same frames as those covered in FIG. 6A.

Referring again to FIG. 1A, the method 100 then proceeds to step 125 where the pitch of each note is calculated using the fundamental frequencies F(y) of the frames of notes, with the fundamental frequencies F(y) having been calculated in step 110. However, the boundaries of the notes obtained in step 120 may include some transients. FIG. 6A shows another graph of an example HPE distribution, which includes a frame associated with a short pause. FIG. 6B shows a graph of the fundamental frequency distribution of the same frames as those covered in FIG. 6A. It can be seen that the 3 frames that follow the short pause frame have not come to a steady state in the fundamental frequency distribution. As a result, step 125 includes post-processing to ensure that the calculation of the pitch of each note takes into account only a steady state voiced section of a note. In particular, the post-processing refines the boundaries of notes.

Figure 1F:
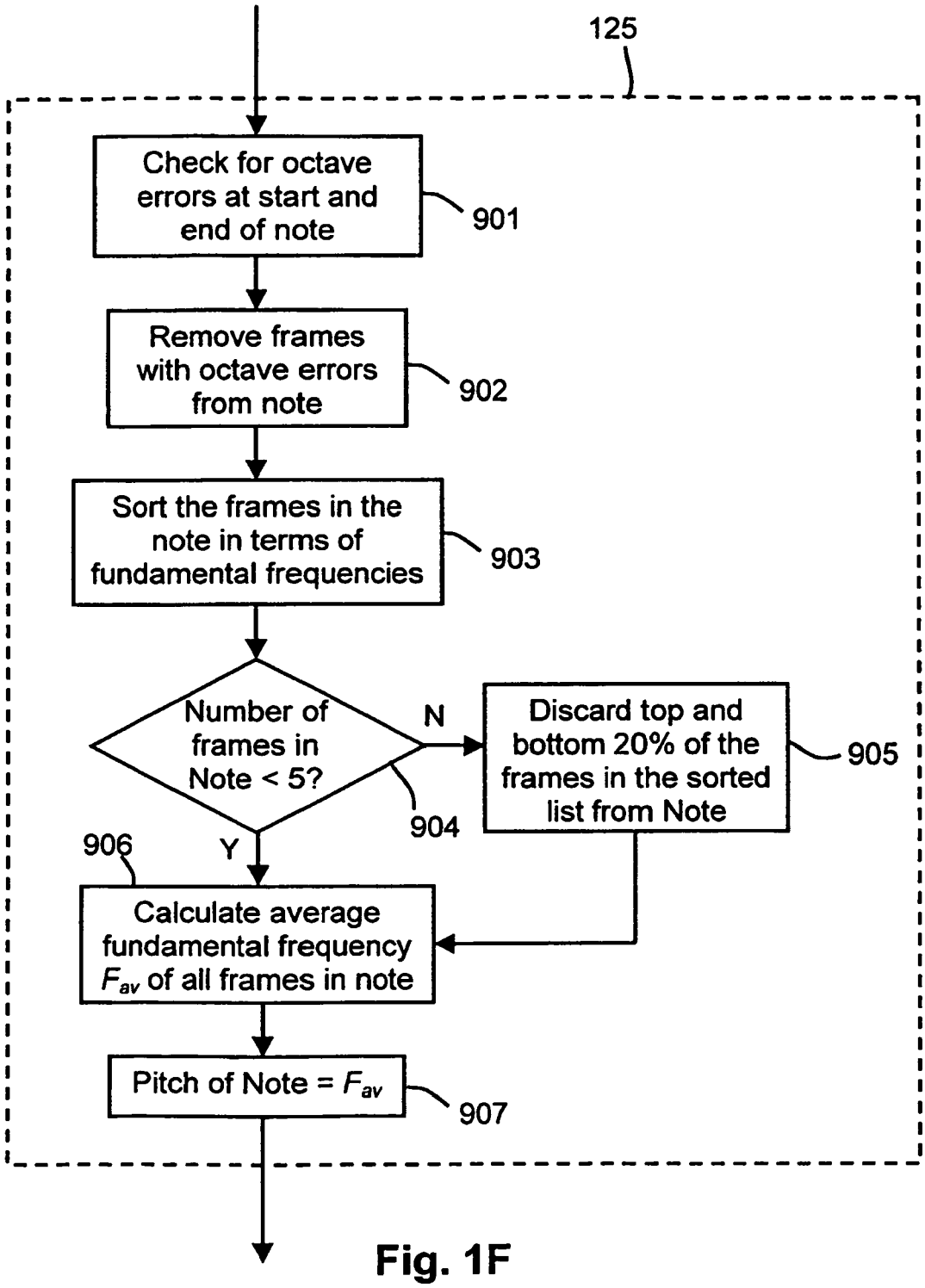

FIG. 1F shows a schematic flow diagram of step 125 which performs the post-processing and calculates the pitch of each note. Step 125 starts in sub-step 901 where the start and end of each note is checked for octave errors. Octave errors occur when the pitch detection performed in step 110 fails to locate the correct fundamental frequency in the spectrum and instead improperly identifies the second harmonics as the fundamental frequency. As a result the value of the final fundamental frequency F(y) of the frame y determined in step 110 will be twice that of the true fundamental frequency.

It is observed that the start and end of notes are most prone to octave errors. The start of each note being prone to octave error could be caused by overemphasis of an unvoiced section at the start of each note. Since it is impossible for the person humming to change pitch drastically within a 2 frame intervals, sub-step 901 simply checks whether the first frame of the note has a fundamental frequency F(y) higher by a predetermined threshold than that of the second frame. In the preferred implementation the predetermined threshold used is 6 semitones. Similarly, sub-step 901 also determines whether the last frame of the note has a fundamental frequency F(y higher by the same predetermined threshold than that of the second last frame. Sub-step 902 then removes the frames with octave errors from the note.

Figure 7:
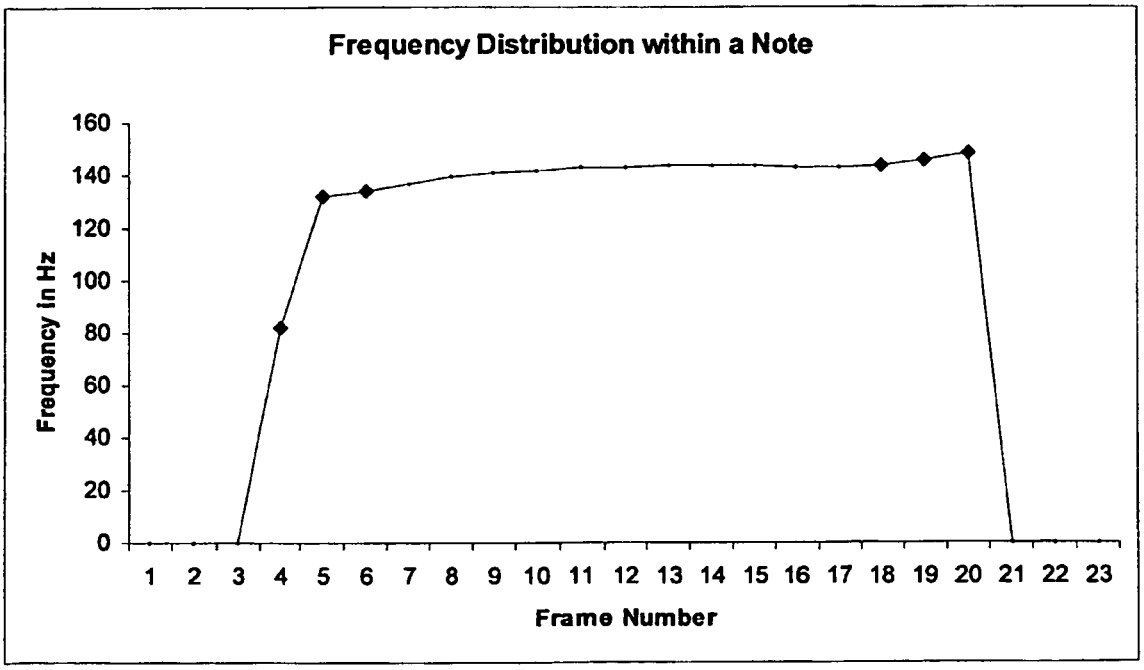
FIG. 7 shows a graph of the fundamental frequency distribution within a single example note.

FIG. 7 shows a graph of the fundamental frequency distribution F(y) within a single example note. It is observed that the start and end of that note, and notes in general, tend to be unstable in terms of their frequencies. Therefore, in sub-step 903 the frames in the note are sorted in terms of their fundamental frequencies F). This enables step 125 to discard the frames having the most extreme fundamental frequencies from the computation of the final pitch of the note.

Next, in sub-step 904 it is determined whether the number of frames in the note is less than 5. If the number of frames in the note is greater than or equal than 5, then step 125 continues in sub-step 905 where a predetermined percentage of frames are discarded from each end of the sorted list. Preferably the predetermined percentage is set to be 20%. For example, if there are 10 frames in the note, the 2 frames that have the highest fundamental frequencies and the 2 frames that have the lowest fundamental frequencies are discarded. In the case where the number of frames in the note is less than 5, no frames are discarded since the number of frames left after such a discard will then be less than 3.

It is noted that sub-step 905 discards the frames having the highest and lowest fundamental frequencies, irrespective of where such frames are located. As explained above, the starts and ends of notes are typically unstable. Accordingly, it is typical that most of the discarded frames are located at the start or end of the note.

Sub-step 906 then calculates the average of the fundamental frequencies $F_{av}$ of the frames remaining in the note. Finally, in sub-step 907, the final pitch of the note under consideration is given the value of the average fundamental frequency $F_{av}$.

As set out in detail above, the method 100 converts the data stream obtained from human humming into musical notes. The segmentation which uses the HPE is an important part of the method 100, as the use of the HPE allows the method 100 to go beyond prior art methods which use traditional segmentation methods that rely on amplitude or average energy. When amplitude or average energy is used, only pauses that are either long enough or has a substantial amount of dip in energy can be detected. The method 100 thus allows a user to hum naturally without consciously trying to deliberately pause between notes, which may not be easy for some users with little musical background. The post-processing performed in step 125 also allows the system 200 to tolerate a user's failure to maintain a constant pitch within a single note. The increased accuracy and robustness in segmentation of notes achieved through method 100 hence brings about an increase in accuracy and robustness in overall transcription of a humming signal into musical notes.

The foregoing describes only some embodiments of the present invention, and modifications and/or changes can be made thereto without departing from the scope and spirit of the invention, the embodiments being illustrative and not restrictive.

REFERENCE

[1] Rodger J. McNab, Lloyd A. Smith, Ian H. Witten, "Signal Processing for Melody Transcription", Department of Computer Science, University of Waikato, Hamilton, New Zealand

[2] Rui Pedro Paiva, Teresa Mendes, Amilcar Cardoso, "A Methodology for Detection of Melody in Polyphonic Musical Signals", Audio Engineering Society Convention Paper 6029

[3] Goffredo Haus, Emanuele Pollastri, "An Audio Front End for Query-by-Humming Systems", L.I.M.—Laboratorio di Informatica Musicale, Dipartmento di Scienze dell'Informazione, Universita Statale di Milano

[4] Juan Pablo Bello, Giuliano Monti, Mark Sandler, "Techniques for Automatic Music Transcription", Department of Electronic Engineering, King's College London, Strand, London WC2R 2LS, UK

[5] U.S. Pat. No. 5,874,686, "Apparatus and method for searching a melody"

[6] U.S. Pat. No. 5,038,658, "Method for automatically transcribing music and apparatus therefore"

[7] WO2004034375, "Method and apparatus for determining musical notes from sounds"

We claim:

1. A computer-implemented method for segmenting a data sample stream of a humming signal into musical notes using a computer system, said method comprising the steps of:

grouping said data sample stream into frames of data samples;

processing each frame of data samples to derive a frequency distribution for each of said frames;

processing said frequency distributions of said frames to derive a Harmonic Product Energy (HPE) distribution; and segmenting said HPE distribution to obtain boundaries of musical notes.

2. The method according to claim 1 wherein the derivation of said HPE distribution comprises the sub-steps of:

subjecting the frequency distribution of each of said frames to a peak detection process to find tonal components of each frame, if tonal components exist;

classifying frames with no tonal components as noise frames;

grouping the tonal components of each non-noise frame harmonically to form harmonic groups for each non-noise frame;

multiplying the energies of all tonal components within the respective groups to derive the HPE of the associated group;

identifying for each non-noise frame a group with the largest HPE; and designating said largest HPE as the HPE of the associated frame.

3. The method according to claim 1 wherein said segmenting step comprises the sub-steps of:

setting the HPE of noise frames to zero;

obtaining a threshold value from said HPE distribution; and labelling regions within said HPE distribution having values below said threshold as long or distinct pauses, with said long or distinct pauses defining said boundaries of musical notes.

4. The method according to claim 1 wherein said segmenting step comprises the sub-steps of:

identifying local minima having values substantially smaller than adjoining local maxima within said HPE distribution; and labelling identified local minima as short pauses, said short pauses defining said boundaries of musical notes.

5. The method according to claim 1 comprising the further steps of:

processing said frequency distributions of said frames to derive a fundamental frequency distribution; and determining a pitch for each note from said fundamental frequency distribution.

6. The method according to claim 5 wherein the derivation of said fundamental frequency distribution comprises the sub-steps of:

subjecting the frequency distribution of each of said frames to a peak detection process to find tonal components of each frame, if tonal components exist;

classifying frames with no tonal components as noise frames;

grouping the tonal components of each non-noise frame harmonically to form harmonic groups for each non-noise frame;

multiplying the energies of all tonal components within the respective groups to derive the HPE of the associated group;

identifying for each non-noise frame a group with the largest HPE;

identifying within said group with the largest HPE a smallest frequency; and designating said smallest frequency as the fundamental frequency of the associated frame.

7. The method according to claim 5 wherein the step of determining said pitch of each musical note comprises averaging the frequencies of all the frames confined within the boundaries the respective musical notes.

8. The method according to claim 1 comprising the further step of refining said boundaries of said musical notes, said refining step comprising the sub-steps of:

eliminating a first frame of any of said musical notes if the absolute difference in the frequency of said first frame and the frequency of a second frame is greater that a predetermined value; and eliminating a last frame of any of said musical notes if the absolute difference in the frequency of said last frame and the frequency of a second last frame is greater that a predetermined value.

9. The method according to claim 1 comprising the further step of refining said boundaries of said musical notes, said refining step comprising the sub-steps of:

sorting the frames within each of said musical notes according to their respective frequencies to form a sorted list; and eliminating from each of said musical notes a predetermined percentage of frames from the top and bottom of said sorted list.

10. Apparatus for segmenting a data sample stream of a humming signal into musical notes, said apparatus comprising:

means for grouping said data sample stream into frames of data samples;

means for processing each frame of data samples to derive a frequency distribution for each of said frames;

means for processing said frequency distributions of said frames to derive a Harmonic Product Energy (HPE) distribution; and means for segmenting said HPE distribution to obtain boundaries of musical notes.

11. A computer program product including a computer readable medium having recorded thereon a computer program for implementing a method of segmenting a data sample stream of a humming signal into musical notes, said method comprising the steps of:

grouping said data sample stream into frames of data samples;

processing each frame of data samples to derive a frequency distribution for each of said frames;

processing said frequency distributions of said frames to derive a Harmonic Product Energy (HPE) distribution; and segmenting said HPE distribution to obtain boundaries of musical notes.

* * * * *